US010408580B1

(12) United States Patent
Pierce

(10) Patent No.: US 10,408,580 B1
(45) Date of Patent: Sep. 10, 2019

(54) PORTABLE SHOOTING RANGE

(71) Applicant: Clifford Pierce, Oroville, CA (US)

(72) Inventor: Clifford Pierce, Oroville, CA (US)

( * ) Notice: Subject to any disclaimer, the term of this patent is extended or adjusted under 35 U.S.C. 154(b) by 0 days.

(21) Appl. No.: 16/167,626

(22) Filed: Oct. 23, 2018

(51) Int. Cl.
*F41J 7/00* (2006.01)
*F41J 11/00* (2009.01)

(52) U.S. Cl.
CPC ..... *F41J 7/00* (2013.01); *F41J 11/00* (2013.01)

(58) Field of Classification Search
CPC ..... F41J 1/10; F41J 9/02; F41J 7/02; F41J 7/00; A45F 3/44
USPC ..... 273/359, 406, 407; 248/61; 211/122, 211/119.03, 119.04, 119.16, 94.02; 212/88, 90, 94, 99; 40/607.05–607.09
See application file for complete search history.

(56) References Cited

U.S. PATENT DOCUMENTS 761,784 A 6/1904 Quackenbush
1,281,687 A 10/1918 Stelling
1,727,272 A 9/1929 Caswell
2,290,297 A 7/1942 Smith
2,292,415 A * 8/1942 Waldheim ..... D06F 53/02 211/119.02
2,344,829 A * 3/1944 McAvoy ..... F41J 7/02 104/173.1
2,372,111 A 3/1945 Clarance
2,538,118 A 1/1951 Miller
2,793,038 A * 5/1957 Wallace ..... F41J 9/02 104/120
2,838,309 A 6/1958 Rudolf
3,020,047 A * 2/1962 Spieth ..... F41J 7/02 273/406
3,140,874 A * 7/1964 Jensen ..... F41J 9/02 273/369
3,363,900 A * 1/1968 Cadle ..... F41J 9/02 273/359
3,471,153 A * 10/1969 Baumler ..... F41J 9/02 273/359
3,540,729 A 11/1970 Rahberger
4,072,313 A * 2/1978 Murso ..... F41J 7/02 273/359
4,434,898 A * 3/1984 McCarthy ..... D06F 53/04 211/1.3
4,601,261 A * 7/1986 Genelin ..... A01K 15/027 119/839
4,645,210 A * 2/1987 Patsy ..... A63B 63/06 273/406

(Continued)

FOREIGN PATENT DOCUMENTS

DE 8211046 8/1982

*Primary Examiner* — Mark S Graham

(57) ABSTRACT

The portable shooting range comprises two telescoping poles, two lines, and two clips. The telescoping poles are T-shaped and each pole provides a pulley hanging off of each end of a crossbar. The bottom of each telescoping pole is pointed for insertion into the ground and an upright provides a pair of foot braces located just above the point for pressing the pole into the ground. The telescoping poles are pressed into the ground separated by a pole separation distance and with their crossbars parallel to each other. The two lines are strung between a pulley on each pole such that each line forms a loop and the loops are parallel to each other. A clip is coupled to each line. Each clip may be used to couple a target to the line and the target may be moved downrange by pulling on the line.

15 Claims, 4 Drawing Sheets

(56) References Cited

U.S. PATENT DOCUMENTS

| | | | | | |
|---|---|---|---|---|---|
| 4,890,847 | A * | 1/1990 | Cartee | F41J 7/02 | 273/406 |
| 5,577,734 | A * | 11/1996 | Conroy | F41J 3/0004 | 273/407 |
| 5,974,720 | A * | 11/1999 | Bowling | A01M 31/06 | 43/2 |
| 6,199,866 | B1 * | 3/2001 | Ricco, Sr. | F41J 11/02 | 248/317 |
| 7,338,048 | B1 * | 3/2008 | Hulstine | F41J 1/10 | 211/196 |
| 7,614,626 | B1 * | 11/2009 | Aanerud | F41J 9/02 | 273/366 |
| 7,946,588 | B1 | 5/2011 | Hockman | | |
| 8,074,994 | B1 | 12/2011 | Delphia | | |
| 8,573,417 | B1 * | 11/2013 | Anderson | D06F 53/045 | 211/119.01 |
| 9,879,949 | B2 * | 1/2018 | Roemer | F41J 9/02 | |
| 2008/0088089 | A1 * | 4/2008 | Bliehall | F41J 9/02 | 273/359 |
| 2008/0272548 | A1 * | 11/2008 | Hensley | F41J 1/10 | 273/406 |
| 2009/0189030 | A1 * | 7/2009 | Krasnicki | A45F 3/44 | 248/156 |

* cited by examiner

PORTABLE SHOOTING RANGE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of shooting sports, more specifically, a portable shooting range.

SUMMARY OF INVENTION

The portable shooting range comprises two telescoping poles, two lines, and two clips. The telescoping poles are T-shaped and each pole provides a pulley hanging off of each end of a crossbar. The bottom of each telescoping pole is pointed for insertion into the ground and an upright provides a pair of foot braces located just above the point for pressing the pole into the ground. The telescoping poles are pressed into the ground separated by a pole separation distance and with their crossbars parallel to each other. The two lines are strung between a pulley on each pole such that each line forms a loop and the loops are parallel to each other. A clip is coupled to each line. Each clip may be used to couple a target to the line and the target may be moved downrange by pulling on the line.

An object of the invention is to provide a portable shooting range.

Another object of the invention is to provide two T-shaped poles that may be pressed into the ground and used to suspend two lines between a downrange position and an uprange position.

A further object of the invention is to provide a telescoping upright on each of the two poles for portability.

Yet another object of the invention is to provide a clip on each of the lines for coupling a target to the line so that the line may move the target between the shooter and the downrange position.

These together with additional objects, features and advantages of the portable shooting range will be readily apparent to those of ordinary skill in the art upon reading the following detailed description of the presently preferred, but nonetheless illustrative, embodiments when taken in conjunction with the accompanying drawings.

In this respect, before explaining the current embodiments of the portable shooting range in detail, it is to be understood that the portable shooting range is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the portable shooting range.

It is therefore important that the claims be regarded as including such equivalent construction insofar as they do not depart from the spirit and scope of the portable shooting range. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
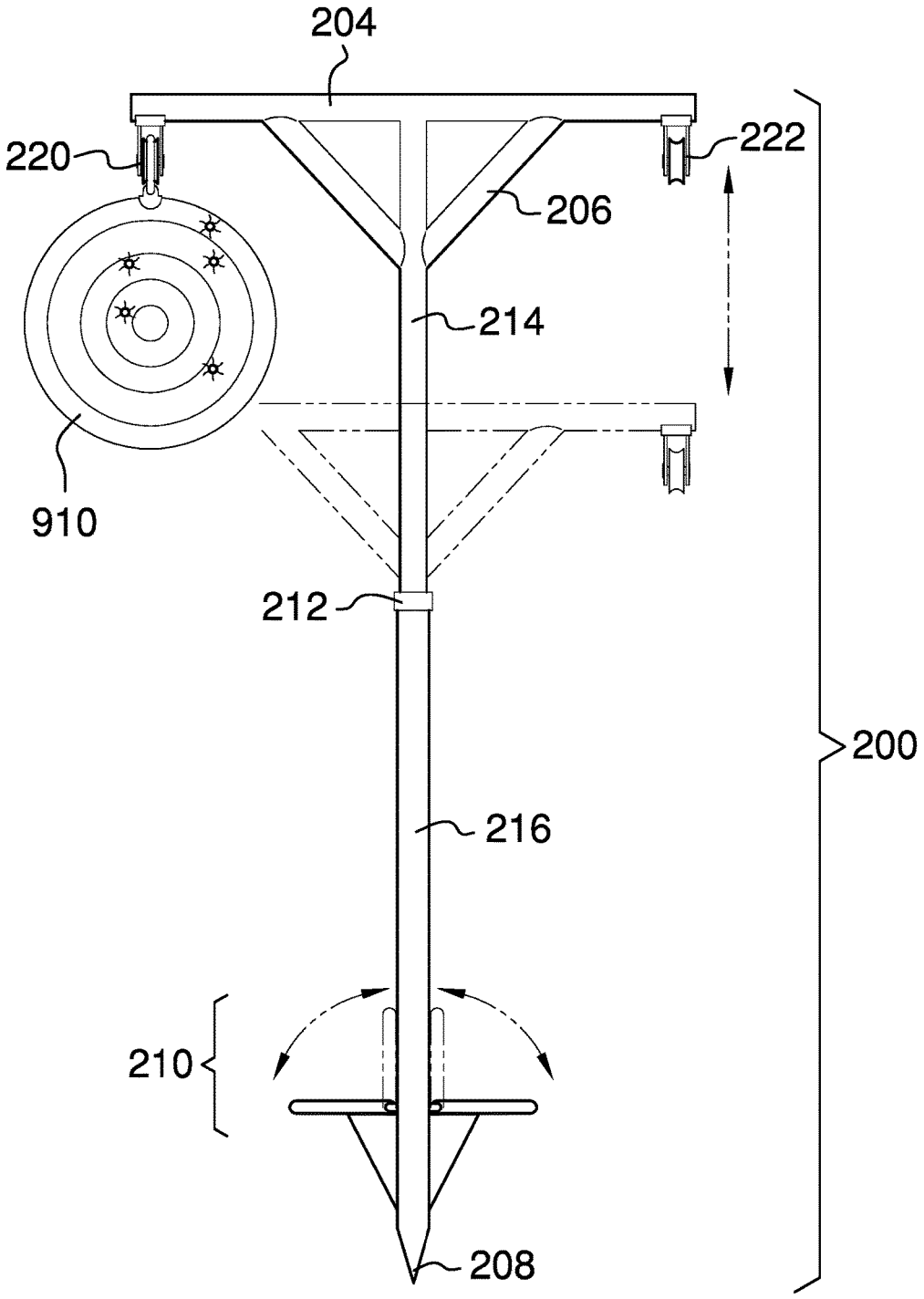
FIG. 1 is a front view of an embodiment of the disclosure.
Figure 2:
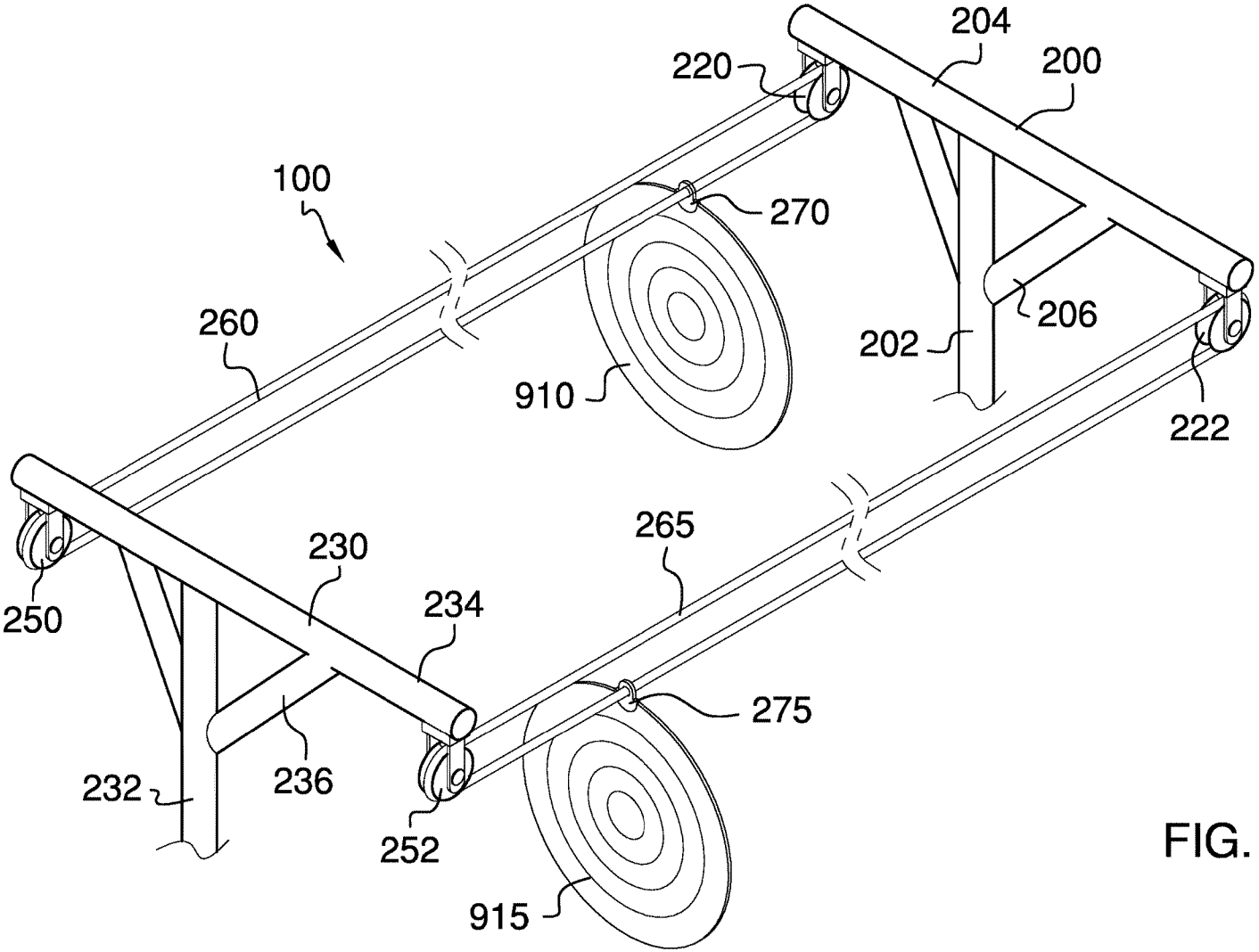
FIG. 2 is a perspective view of an embodiment of the disclosure.
Figure 3:
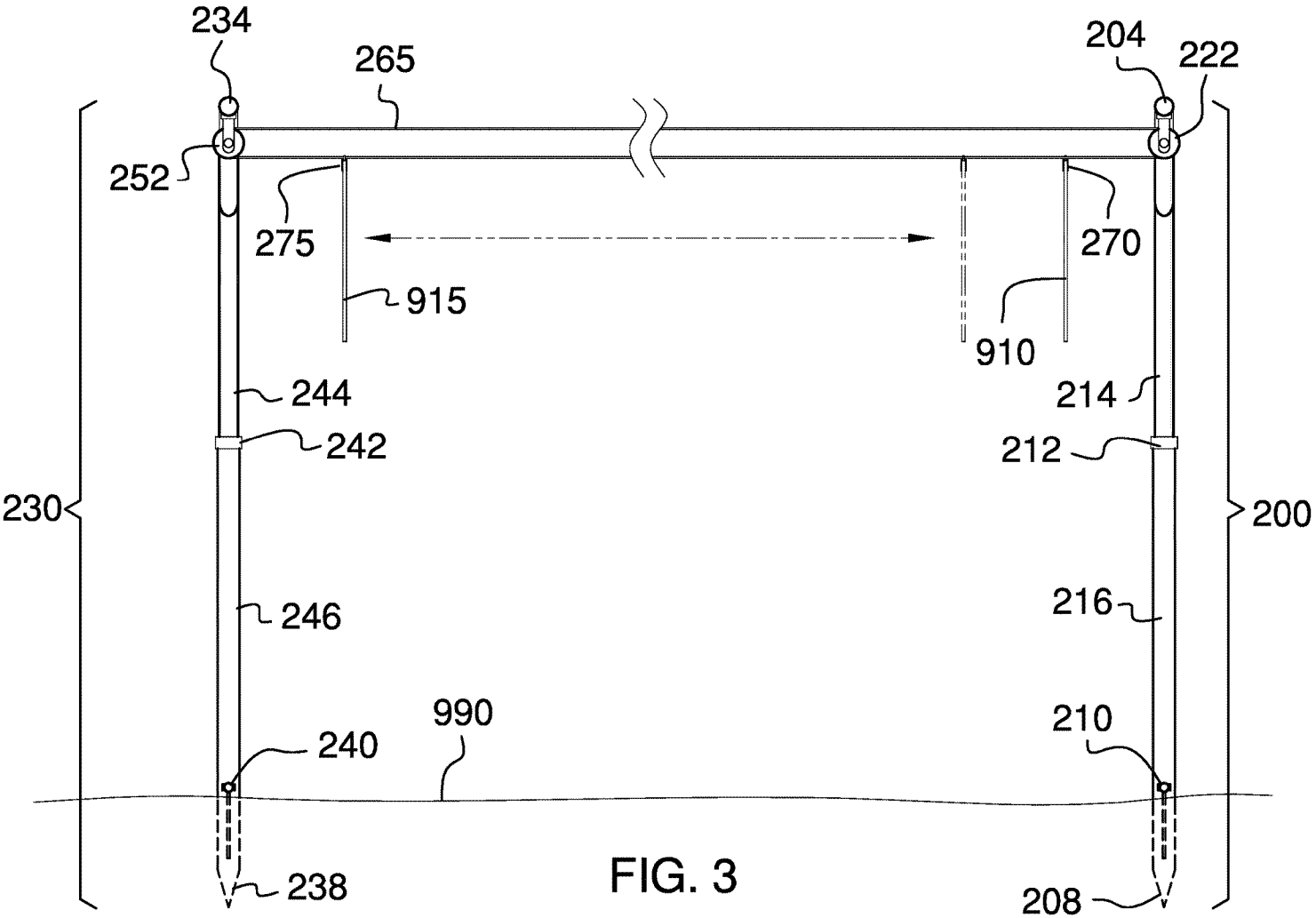
FIG. 3 is a side view of an embodiment of the disclosure.
Figure 4:
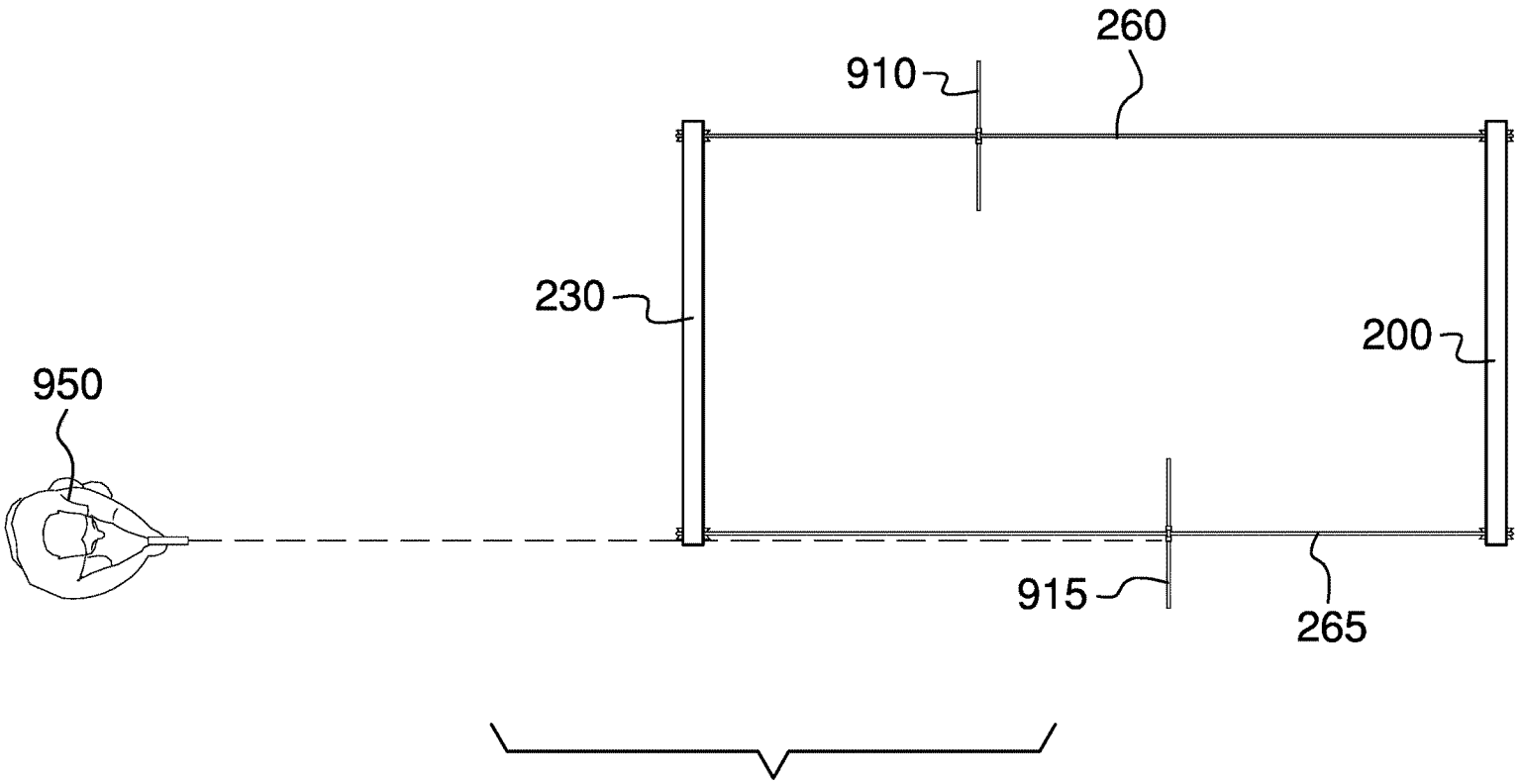
FIG. 4 is a top view of an embodiment of the disclosure.

Detailed reference will now be made to a first potential embodiment of the disclosure, which is illustrated in FIGS. 1 through 4.

The portable shooting range 100 (hereinafter invention) comprises a first telescoping pole 200, a second telescoping pole 230, a first line 260, a second line 265, a first clip 270, and a second clip 275. The invention 100 may be adapted to allow a shooter 950 to position a target downrange by clipping the target to the first clip 270 or the second clip 275 and pulling the first line 260 or the second line 265.

The first telescoping pole 200 may be a T-shaped armature comprising a first upright 202 and a first crossbar 204. The bottom of the first upright 202 terminates at a first point 208. The first telescoping pole 200 may be planted into ground 990 by holding the first telescoping pole 200 with the first point 208 touching the ground 990 and the first upright 202 oriented vertically and then pushing the first point 208 into the ground 990. The first telescoping pole 200 may comprise a first pair of foot braces 210. The first pair of foot braces 210 may be located on the bottom of the first upright 202 above the first point 208. The first pair of foot braces 210 may be adapted for the shooter 950 to press the first telescoping pole 200 into the ground 990 by placing a foot on one side of the first pair of foot braces 210 or the other and using the weight of the shooter 950 to press the first pair of foot braces 210 down. In some embodiments, the first pair of foot braces 210 may be hingedly coupled to the first upright 202 such that the first pair of foot braces 210 may be pivoted down to a position that is perpendicular to the first upright 202 during installation of the first telescoping pole 200 and may be pivoted up to a position that is parallel to the first upright 202 thereafter.

The first upright 202 may comprise a first upper upright 214 and a first lower upright 216 slidably coupled at a first telescoping joint 212. When the first telescoping joint 212 is locked, the position of the first upper upright 214 may be fixed relative to the position of the first lower upright 216. When the first telescoping joint 212 is unlocked, the first upper upright 214 may slide longitudinally relative to the first lower upright 216. Using the first telescoping joint 212, the first upright 202 may be shortened for transportation and lengthened for use at a shooting range. As a non-limiting example, the first telescoping joint 212 may be a ring surrounding the first upright 202 that tightens or loosens the coupling between the first upper upright 214 and the first lower upright 216 when it is twisted one way or the other.

The first crossbar 204 may be located at the top of the first upright 202 and may be oriented parallel to the ground 990. A first pulley 220 may be suspended beneath a first end of the first crossbar 204 and a second pulley 222 may be suspended beneath a second end of the first crossbar 204.

In some embodiments, the first telescoping pole 200 may comprise a first pair of diagonal support braces 206. The first pair of diagonal support braces 206 may be diagonal struts positioned between the first upright 202 and the first crossbar 204 to provide strength and stability for the first crossbar 204.

The second telescoping pole 230 may be a T-shaped armature comprising a second upright 232 and a second crossbar 234. The bottom of the second upright 232 terminates at a second point 238. The second telescoping pole 230 may be planted into the ground 990 by holding the second telescoping pole 230 with the second point 238 touching the ground 990 and the second upright 232 oriented vertically and then pushing the second point 238 into the ground 990. The second telescoping pole 230 may comprise a second pair of foot braces 240. The second pair of foot braces 240 may be located on the bottom of the second upright 232 above the second point 238. The second pair of foot braces 240 may be adapted for the shooter 950 to press the second telescoping pole 230 into the ground 990 by placing a foot on one side of the second pair of foot braces 240 or the other and using the weight of the shooter 950 to press the second pair of foot braces 240 down. In some embodiments, the second pair of foot braces 240 may be hingedly coupled to the second upright 232 such that the second pair of foot braces 240 may be pivoted down to a position that is perpendicular to the second upright 232 during installation of the second telescoping pole 230 and may be pivoted up to a position that is parallel to the second upright 232 thereafter.

The second upright 232 may comprise a second upper upright 244 and a second lower upright 246 slidably coupled at a second telescoping joint 242. When the second telescoping joint 242 is locked, the position of the second upper upright 244 may be fixed relative to the position of the second lower upright 246. When the second telescoping joint 242 is unlocked, the second upper upright 244 may slide longitudinally relative to the second lower upright 246. Using the second telescoping joint 242, the second upright 232 may be shortened for transportation and lengthened for use at a shooting range. As a non-limiting example, the second telescoping joint 242 may be a ring surrounding the second upright 232 that tightens or loosens the coupling between the second upper upright 244 and the second lower upright 246 when it is twisted one way or the other.

The second crossbar 234 may be located at the top of the second upright 232 and may be oriented parallel to the ground 990. A third pulley 250 may be suspended beneath a first end of the second crossbar 234 and a fourth pulley 252 may be suspended beneath a second end of the second crossbar 234.

In some embodiments, the second telescoping pole 230 may comprise a second pair of diagonal support braces 236. The second pair of diagonal support braces 236 may be diagonal struts positioned between the second upright 232 and the second crossbar 234 to provide strength and stability for the second crossbar 234.

The first telescoping pole 200 and the second telescoping pole 230 may be placed into the ground 990, separated by a pole separation distance 290.

The first line 260 may be a flexible material at least twice as long as the pole separation distance 290. As non-limiting examples, the first line 260 may be paracord, rope, twine, string, cable, or wire. The first line 260 may be strung between the first telescoping pole 200 and the second telescoping pole 230 by passing the first line 260 around the first pulley 220 on the first telescoping pole 200 where the first line 260 changes direction by 180 degrees and around the third pulley 250 on the second telescoping pole 230 where the first line 260 changes direction by 180 degrees. The two loose ends of the first line 260 may be brought together and may be coupled to each other to form a loop.

The second line 265 may be a flexible material at least twice as long as the pole separation distance 290. As non-limiting examples, the second line 265 may be paracord, rope, twine, string, cable, or wire. The second line 265 may be strung between the first telescoping pole 200 and the second telescoping pole 230 by passing the second line 265 around the second pulley 222 on the first telescoping pole 200 where the second line 265 changes direction by 180 degrees and around the fourth pulley 252 on the second telescoping pole 230 where the second line 265 changes direction by 180 degrees. The two loose ends of the second line 265 may be brought together and may be coupled to each other to form a loop.

The first clip 270 may be a fastener for removably coupling a first target 910 to the first line 260. The top of the first clip 270 may removable couple to the first line 260. As a non-limiting example, the top of the first clip 270 may comprise an aperture that the first line 260 passes through before the end of the first line 260 are coupled to each other. The bottom of the first clip 270 may removably couple to the first target 910. As a non-limiting example, the bottom of the first clip 270 may comprise a spring clip that may be squeezed to open and released to hold the first target 910 placed within the spring clip. The first clip 270 may be adapted to hold the first target 910 in an orientation that places the first target 910 perpendicular to the first line 260 and therefore facing the shooter 950.

The second clip 275 may be a fastener for removably coupling a second target 915 to the second line 265. The top of the second clip 275 may removable couple to the second line 265. As a non-limiting example, the top of the second clip 275 may comprise an aperture that the second line 265 passes through before the end of the second line 265 are coupled to each other. The bottom of the second clip 275 may removably couple to the second target 915. As a non-limiting example, the bottom of the second clip 275 may comprise a spring clip that may be squeezed to open and released to hold the second target 915 placed within the spring clip. The second clip 275 may be adapted to hold the second target 915 in an orientation that places the second target 915 perpendicular to the second line 265 and therefore facing the shooter 950.

In use, the first telescoping pole 200 and the second telescoping pole 230 are planted into the ground 990, separated from each other by the pole separation distance 290 and oriented such that the first crossbar 204 on the first telescoping pole 200 is parallel to the second crossbar 234 on the second telescoping pole 230. The first telescoping pole 200 and the second telescoping pole 230 may be positioned such that the first telescoping pole 200 is downrange and the second telescoping pole 230 is uprange, generally meaning that the shooter 950 will shoot towards the first telescoping pole 200 from the direction of the second telescoping pole 230 and that a backstop, such as a mound of earth, will be located beyond the first telescoping pole 200 in the direction of fire to stop the rounds.

The first line 260 is strung between the first telescoping pole 200 and the second telescoping pole 230 by passing it through the first pulley 220 on the first telescoping pole 200, through the third pulley 250 on the second telescoping pole 230, and through the first clip 270. The first line 260 is pulled taut and the ends of the first line 260 are coupled to each other. The second line 265 is strung between the first telescoping pole 200 and the second telescoping pole 230 by passing it through the second pulley 222 on the first telescoping pole 200, through the fourth pulley 252 on the second telescoping pole 230, and through the second clip 275. The second line 265 is pulled taut and the ends of the second line 265 are coupled to each other. The shooter 950 may pull the first line 260 to move the first clip 270 towards the second telescoping pole 230 and may pull the second line 265 to move the second clip 275 towards the second telescoping pole 230. The shooter 950 may place the first target 910 into the first clip 270 and may place the second target 915 into the second clip 275. The shooter 950 may pull the first line 260 and the second line 265 to move the first target 910 and the second target 915 towards the first telescoping pole 200. The shooter 950 may fire one or more rounds at the first target 910 and at the second target 915. The shooter 950 may then pull the first line 260 and the second line 265 to move the targets back to the second telescoping pole 230 where the targets may be examined and replaced.

The portability of the invention 100 allows it to be set up and taken down many times at different venues.

Definitions

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" refers to top and "lower" refers to the bottom. As a non-limiting example, the upper end of a vertical shaft is the top end of the vertical shaft.

As used in this disclosure, an "aperture" is an opening in a surface. Aperture may be synonymous with hole, slit, crack, gap, slot, or opening.

As used in this disclosure, a "clip" is a fastener that attaches to an object by gripping or clasping the object. A clip is typically spring loaded.

As used herein, the words "couple", "couples", "coupled" or "coupling", refer to connecting, either directly or indirectly, and does not necessarily imply a mechanical connection.

As used herein, "downrange" and "uprange" refer to horizontal directions relative to a target and/or a firing position. Downrange may refer to a position closer to the target or farther away from the firing position. Downrange may also refer to movement towards the target or away from the firing position. Uprange may refer to a position farther away from the target or closer to the firing position. Uprange may also refer to movement away from the target or towards the firing position.

As used in this disclosure, a "fastener" is a device that is used to join or affix two objects. Fasteners generally comprise a first element, which is attached to the first object and a second element which is attached to the second object such that the first element and the second element join to affix the first object and the second object. Common fasteners include, but are not limited to, hooks, zippers, snaps, clips, ties, buttons, buckles, quick release buckles, or hook and loop fasteners.

As used in this disclosure, "flexible" refers to an object or material which will deform when a force is applied to it, which will not return to its original shape when the deforming force is removed, and which may not retain the deformed shape caused by the deforming force.

As used herein, the word "longitudinal" or "longitudinally" refers to a lengthwise or longest direction.

As used in this disclosure, "orientation" refers to the positioning and/or angular alignment of a first object relative to a second object or relative to a reference position or reference direction.

As used herein, the word "portable" refers to a device that may be carried by a single person and may be used at multiple locations. In some cases, portable may imply that the device may be used while being carried.

As used in this disclosure a "pulley" is a wheel with a grooved rim around which a cord (or other form of rope, line, or cable) passes. The pulley is used to change the direction of a force applied to the cord.

As used in this disclosure, a "spring" is a device that is used to store mechanical energy. This mechanical energy will often be stored by deforming an elastomeric material that is used to make the device, by the application of a torque to a rigid structure, or by a combination thereof. In some embodiments, the rigid structure to which torque is applied may be composed of metal or plastic.

As used in this disclosure, "telescopic", "telescoping", and "telescopically" refer to an object made of sections that fit or slide into each other such that the object can be made longer or shorter by adjusting the relative positions of the sections.

With respect to the above description, it is to be realized that the optimum dimensional relationship for the various components of the invention described above and in FIGS. 1 through 4, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A portable shooting range comprising:

a first telescoping pole, a second telescoping pole, a first line, a second line, a first clip, and a second clip;

wherein the portable shooting range is adapted to allow a shooter to position a target downrange by clipping the target to the first clip or the second clip and pulling the first line or the second line;

wherein the first telescoping pole is a T-shaped armature comprising a first upright and a first crossbar;

wherein the bottom of the first upright terminates at a first point;

wherein the first telescoping pole is planted into ground by holding the first telescoping pole with the first point touching the ground and the first upright oriented vertically and then pushing the first point into the ground;

wherein the first telescoping pole comprises a first pair of foot braces;

wherein the first pair of foot braces is located on the bottom of the first upright above the first point;

wherein the first pair of foot braces is adapted for the shooter to press the first telescoping pole into the ground by placing a foot on one side of the first pair of foot braces or the other and using the weight of the shooter to press the first pair of foot braces down;

wherein the first pair of foot braces is hingedly coupled to the first upright such that the first pair of foot braces is pivoted down to a position that is perpendicular to the first upright during installation of the first telescoping pole and is pivoted up to a position that is parallel to the first upright thereafter;

wherein the first upright comprises a first upper upright and a first lower upright slidably coupled at a first telescoping joint;

wherein when the first telescoping joint is locked, the position of the first upper upright is fixed relative to the position of the first lower upright;

wherein when the first telescoping joint is unlocked, the first upper upright slides longitudinally relative to the first lower upright;

wherein using the first telescoping joint, the first upright is shortened for transportation and lengthened for use at a shooting range;

wherein the first crossbar is located at the top of the first upright and is oriented parallel to the ground;

wherein a first pulley is suspended beneath a first end of the first crossbar and a second pulley is suspended beneath a second end of the first crossbar.

2. The portable shooting range according to claim 1 wherein the first telescoping pole comprises a first pair of diagonal support braces;

wherein the first pair of diagonal support braces comprises diagonal struts positioned between the first upright and the first crossbar to provide strength and stability for the first crossbar.

3. The portable shooting range according to claim 1 wherein the second telescoping pole is a T-shaped armature comprising a second upright and a second crossbar;

wherein the bottom of the second upright terminates at a second point;

wherein the second telescoping pole is planted into the ground by holding the second telescoping pole with the second point touching the ground and the second upright oriented vertically and then pushing the second point into the ground.

4. The portable shooting range according to claim 3 wherein the second telescoping pole comprises a second pair of foot braces;

wherein the second pair of foot braces is located on the bottom of the second upright above the second point;

wherein the second pair of foot braces is adapted for the shooter to press the second telescoping pole into the ground by placing a foot on one side of the second pair of foot braces or the other and using the weight of the shooter to press the second pair of foot braces down.

5. The portable shooting range according to claim 4 wherein the second pair of foot braces is hingedly coupled to the second upright such that the second pair of foot braces is pivoted down to a position that is perpendicular to the second upright during installation of the second telescoping pole and is pivoted up to a position that is parallel to the second upright thereafter.

6. The portable shooting range according to claim 5 wherein the second upright comprises a second upper upright and a second lower upright slidably coupled at a second telescoping joint;

wherein when the second telescoping joint is locked, the position of the second upper upright is fixed relative to the position of the second lower upright;

wherein when the second telescoping joint is unlocked, the second upper upright slides longitudinally relative to the second lower upright;

wherein using the second telescoping joint, the second upright is shortened for transportation and lengthened for use at a shooting range.

7. The portable shooting range according to claim 6 wherein the second crossbar is located at the top of the second upright and is oriented parallel to the ground;

wherein a third pulley is suspended beneath a first end of the second crossbar and a fourth pulley is suspended beneath a second end of the second crossbar.

8. The portable shooting range according to claim 7 wherein the second telescoping pole comprises a second pair of diagonal support braces;

wherein the second pair of diagonal support braces comprises diagonal struts positioned between the second upright and the second crossbar to provide strength and stability for the second crossbar.

9. The portable shooting range according to claim 7 wherein the first telescoping pole and the second telescoping pole are placed into the ground, separated by a pole separation distance.

10. The portable shooting range according to claim 9 wherein the first line is a flexible material at least twice as long as the pole separation distance.

11. The portable shooting range according to claim 10 wherein the first line is strung between the first telescoping pole and the second telescoping pole by passing the first line around the first pulley on the first telescoping pole where the first line changes direction by 180 degrees and around the third pulley on the second telescoping pole where the first line changes direction by 180 degrees;

wherein the two loose ends of the first line are brought together and are coupled to each other to form a loop.

12. The portable shooting range according to claim 11 wherein the second line is a flexible material at least twice as long as the pole separation distance.

13. The portable shooting range according to claim 12 wherein the second line is strung between the first telescoping pole and the second telescoping pole by passing the second line around the second pulley on the first telescoping pole where the second line changes direction by 180 degrees and around the fourth pulley on the second telescoping pole where the second line changes direction by 180 degrees;

wherein the two loose ends of the second line are brought together and are coupled to each other to form a loop.

14. The portable shooting range according to claim 13 wherein the first clip is a fastener for removably coupling a first target to the first line;

wherein the top of the first clip removably couples to the first line;

wherein the bottom of the first clip removably couples to the first target;

wherein the first clip is adapted to hold the first target in an orientation that places the first target perpendicular to the first line and therefore facing the shooter.

15. The portable shooting range according to claim 14 wherein the second clip is a fastener for removably coupling a second target to the second line;

wherein the top of the second clip removably couples to the second line;

wherein the bottom of the second clip removably couples to the second target;

wherein the second clip is adapted to hold the second target in an orientation that places the second target perpendicular to the second line and therefore facing the shooter.

* * * * *